United States Patent [19]

Riviera

[11] Patent Number: 4,687,201

[45] Date of Patent: Aug. 18, 1987

[54] SYMBOL PUZZLE

[76] Inventor: Paul Riviera, 1310 Pennsylvania Ave., Brooklyn, N.Y. 11239

[21] Appl. No.: 871,345

[22] Filed: Jun. 6, 1986

[51] Int. Cl.[4] ..... A63F 9/06

[52] U.S. Cl. ..... 273/153 R; 283/1 R

[58] Field of Search ..... 273/153 R, 240, 272; 283/1 R, 46; 434/177

[56] References Cited

U.S. PATENT DOCUMENTS

| | | | |
|---|---|---|---|
| 4,185,830 | 1/1980 | James | 273/153 R |
| 4,215,864 | 8/1980 | Nichols | 273/153 R |
| 4,299,578 | 11/1981 | Wayman | 434/177 |
| 4,575,125 | 3/1986 | Augier | 283/1 R |

*Primary Examiner*—Anton O. Oechsle

*Attorney, Agent, or Firm*—Blum, Kaplan

[57] ABSTRACT

A puzzle including a plurality of symbols each of which is representative of at least two characters. Some of the symbols are adapted to be selectively converted to any one of the at least two corresponding characters, and some of the symbols are adapted to be selectively converted to at least one of the at least two corresponding characters or selectively not converted and thus represent the remaining one of the at least two characters. A matrix of defined spaces includes spaces adapted to contain a symbol. Each of the defined spaces contains a symbol. The puzzle is solved by converting some of the symbols to the appropriate corresponding character. As a crossword puzzle, the symbols correspond to at least two letters and a series of clues are used to assist in solving the puzzle.

25 Claims, 3 Drawing Figures

ACROSS

1 VATICAN LOCATION
5 ALLEY DWELLERS
9 VERVE
10 HE HAD AN IRISH ROSE
11 LIKE A PIN
12 HAMMER PART
13 TILE GAME
15 TWENTIETH _____
16 SUMMER IN PARIS

DOWN

1 TEAR APART
2 TABLE SPREAD
3 INFORMAL ADDRESS TO WOMAN
4 ATTRACT
5 CHICAGO GANGSTER
6 RED AS ___ ___
7 BINDS: 2 WDS
8 GINZA COIN
14 FISHERMAN'S TOOL

ACROSS

1 VATICAN LOCATION
5 ALLEY DWELLERS
9 VERVE
10 HE HAD AN IRISH ROSE
11 LIKE A PIN
12 HAMMER PART
13 TILE GAME
15 TWENTIETH _____
16 SUMMER IN PARIS

DOWN

1 TEAR APART
2 TABLE SPREAD
3 INFORMAL ADDRESS TO WOMAN
4 ATTRACT
5 CHICAGO GANGSTER
6 RED AS ___ _____
7 BINDS: 2 WDS
8 GINZA COIN
14 FISHERMAN'S TOOL

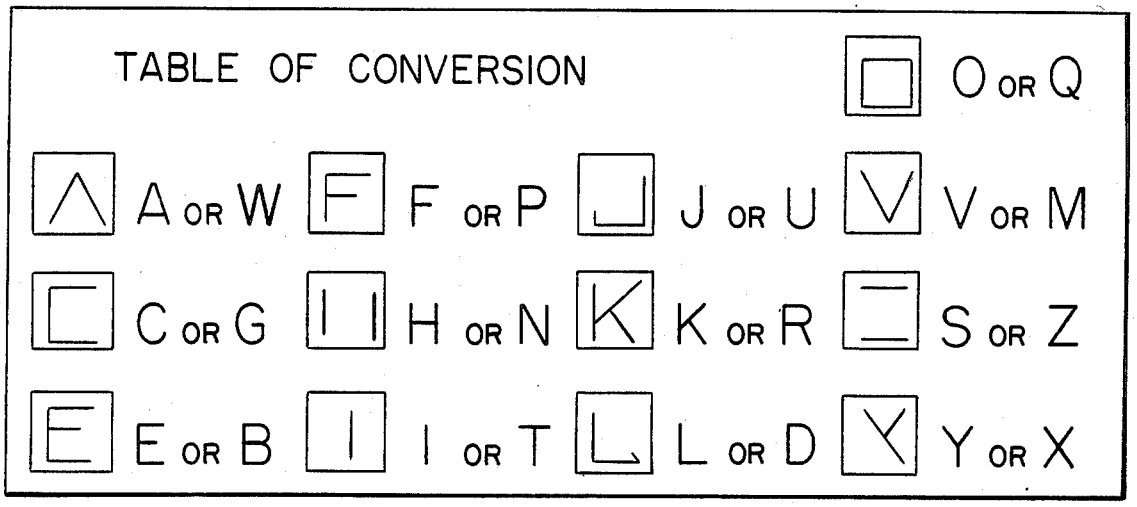
FIG. 2
FIG. 3
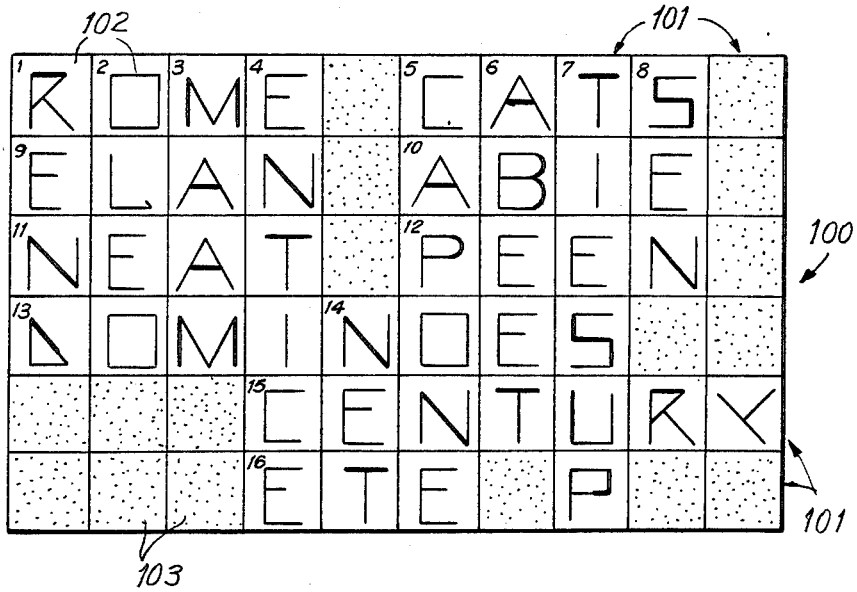

SYMBOL PUZZLE

BACKGROUND OF THE INVENTION

The invention is generally directed to puzzles and in particular to a crossword type puzzle in which the puzzle boxes are pre-marked with symbols. The symbols are representative of two or more different letters and may be adapted by the addition of appropriate lines into the appropriate letters solving the clue.

Traditionally, crossword puzzles are formed as grids with empty squares and blacked in squares separating the blanked out squares. Each blank square is filled with a single letter and the groups of blank squares form words both across and down. The blacked in squares separate the groups of blank squares forming words.

Each blank square which is the start of a word, either across or down, is numbered. A series of clues for words which go across and down, keyed to the numbered boxes, is generally provided with the crossword puzzle. In this way a puzzle solver would look to a word starting at a numbered blank space, count the number of blank spaces in the word indicitive of the length of the word and check the corresponding clue. Based on the clue and the length of the word, the puzzle solver fills in each of the blank spaces with a letter. Next, the puzzle solver proceeds to fill in another word, usually a word sharing a common letter with the filled in word. The filled in letters in the words provide a further clue to the solution of the crossword puzzle. As more of the clues are solved, additional clues in the form of known letters in a word are present.

If the puzzle solver is unable to determine which word should be filled in corresponding to a clue, additional clues can be obtained by solving words sharing common squares with the unknown word in the opposite direction. For example, if a word going across is unknown, additional letters can be obtained by solving the words which go down, each such word sharing a single letter with the unknown word.

In this way, a puzzle solver can work through the puzzle, finishing the puzzle when all of the blank squares have been filled in. Because of the interlocking nature of crossword puzzles, any error made in filling in words creates problems in words which interlock. Even a few erroneously filled in words can propagate through the puzzle and prevent its solution. If a four letter word going across at the top of the puzzle is filled in incorrectly, major problems can ensue. For example, if the puzzle solver utilizes the incorrect letter in attempting to fill in the intersecting words going down, words starting with an incorrect letter will be inserted. This will likely cause further confusion and problems in filling in words going across beneath the incorrectly filled in word.

Solution of the puzzle is virtually impossible for many people due to the variable difficulty of crossword puzzles and the insertion of a large number of incorrect words.

In fact, many puzzle solvers rarely solve a complete puzzle due to the propagation effect of even a single error in a crossword puzzle. As a result of the frustration resulting from the inability to complete the puzzle and the misleading information provided by incorrectly filled in blanks, many puzzle solvers stop even attempting crossword puzzles. Many others never even try because of their fear of failure.

Accordingly, there is a need for an improved puzzle, such as a crossword puzzle, which avoids the propagation effect of incorrectly filled in blanks, creates a realistic opportunity to complete a puzzle and reduces the need to erase errors.

SUMMARY OF THE INVENTION

The invention is generally directed to a puzzle. The puzzle includes a plurality of symbols, each of which is representative of at least two characters and adapted to be selectively converted into any one of the at least two corresponding characters, or selectively not converted and thereby representing the remaining one of the at least two characters. The puzzle has a matrix of defined spaces. Each of the spaces is either of a first type adapted to receive a character therein or a second type adapted to receive no characters. Each of the defined spaces of the first type contains a character. The puzzle is solved by converting at least some of the symbols to the appropriate corresponding character.

Accordingly, it is an object of the invention to provide an improved puzzle.

Another object of the invention is to provide an improved crossword puzzle with pre-filled characters corresponding to at least two separate letters.

A further object of the invention is to provide an improved crossword puzzle which prevents propagation of errors due to incorrectly filled in words.

Another object of the invention is to provide an improved crossword puzzle which prevents incorrect letter filling in and the need to erase or write over an answered letter.

Still another object of the invention is to provide an improved crossword puzzle which requires the alteration of designated symbols, each of which is representative of at least two basic characters, to one of the basic characters in solving the puzzle.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2 is a conversion table for converting symbols to letters in accordance with a preferred embodiment of the invention; and FIG. 3 is the puzzle of FIG. 1 solved, with the added lines shown in heavy black lines.

DETAILED DESCRIPTION OF THE PREFERRED EMBODIMENT

Figure 1:
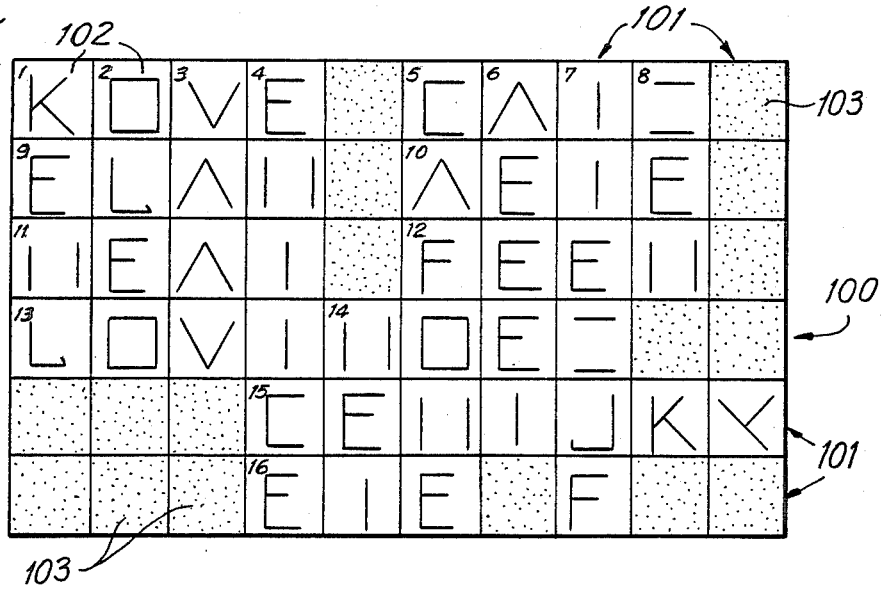
FIG. 1 is a drawing of a puzzle constructed in accordance with a preferred embodiment of the invention, prior to solution and including relevant clues.

Reference is made to FIG. 1 wherein a puzzle 100 constructed in accordance with a preferred embodiment of the invention is depicted. Puzzle 100 includes a matrix of squares 101, some of which have symbols, generally indicated as 102 and are adapated to eventually contain single letters and other spaces, generally indicated as 103 which are shown as stippled. The stippled squares 103 are generally solid black in a puzzle and separate groupings of the symbol filled squares 102. Each of the symbol filled squares 103, which is the beginning of a word either across or down, is designated with a number. The number corresponds to a clue for the word, either across or down. For example, the box in the upper left corner is box 1. Two words begin in this box, one going across and another coming down. Thus, there is a clue for 1 Across and a separate clue for 1 Down.

The clues, shown in FIG. 1, correspond to all of the separate words, formed either across or down in the puzzle matrix.

Each of the squres 102, adapted to contain a letter when the puzzle is solved, contains a symbol or character which is representative of two distinct letters. Reference is made to FIG. 2 wherein a conversion table shows the relationship between the 13 symbols and the 26 letters. Each of the 13 symbols corresponds to two distinct letters. For example, the symbol in the box numbered 1 can correspond to either a "K" or a "R". No other symbol in this embodiment corresponds to a "K" or an "R".

Each of the symbols is convertible into both of the letters to which the symbol corresponds either by the addition of a line or lines or by making no changes. For example, the symbol corresponding to "H" or "N" is formed of two spaced apart vertical lines. It requires the addition of either a horizontal line connecting the center of the two vertical lines or a single diagonal line connecting the upper end of the left vertical line to the bottom of the right line. On the other hand, the symbol corresponding to "F" or "P" is a letter "F". Thus, if the correct letter is an F, no change is made to the symbol. If the selected letter is a "P", then an additional curved line is added as shown in box number 12 of FIG. 3. FIG. 3 shows the solution to puzzle 100 of FIG. 1. Each of the added lines is shown highlighted as a thick and a heavy black line.

A puzzle solver beginning with the puzzle of FIG. 1 might start by looking at the clue for 1 Across, which is "Vatican location". If the puzzle solver knows that the answer is "ROME" then the symbol in box 1 can be converted to an "R" by a single horizontal line at the top of the symbol. The symbol in box 2 requires no alteration. The symbol in box 3 requires two vertical lines at the upper ends of the symbol and the symbol in box 4 requires on change. As shown in FIG. 3, the word "ROME" is now depicted.

If, however, the puzzle solver does not know the correct solution based on the clue and number of letters in the word that is 1 Across, two options are available. The first option is to move onto another clue, such as 1 Down; or utilize the symbols to help solve the word. For example, the character in box 2 can either be an "O" or an "Q". However, the symbol in box 3 is representative of either an "V" or "M". Because English language words generally require a "U" to follow a "Q" and box 3 cannot be "U", box 2 cannot be a "Q" and thus must be an "O". Then, by a series of trial and error attempts, the puzzle solver could figure out the solution to the clue for 1 Across.

If even with this assist the puzzle solver is unable to determine what the solution to 1 Across is, the second option open to the puzzle solver is to get additional clues to the solution of 1 Across by solving words sharing boxes with the 1 Across word. For example, the puzzle solver can look at the clue for 1 Down which is "Tear apart". If the puzzle solver knows that "REND" is the solution to the clue of 1 Down, the additions noted as the heavy black lines in boxes 1, 11 and 13 are made.

Next, the puzzle solver can return to 1 Across knowing that the first letter is a "R" and perhaps that the second letter is an "O". Based on this, the puzzle solver may be able to fill in the last two letters of the 1 Across word. If the puzzle solver still does not know the solution to 1 Across additional clues to the word can be obtained by solving the words for 3 Down and 4 Down. In this way, even if the puzzle solver has no idea as to the answer to the clue for 1 Across, the puzzle can still be solved by solving relevant boxes through crossing words sharing common boxes and elimination of letter possibilities based on the conversion table.

In addition, if the puzzle solver believes that the answer to 1 Across is "LIDO", he can not enter this word without recognizing that it must be incorrect. Because of the symbol in box 1, the puzzle solver knows that the first letter of the word must either be a "K" or an "R". Thus, LIDO is not a possible solution to 1 Across. This prevents the puzzle solver from incorrectly filling in letters which causes the propagation of errors through the puzzle. Also, there is a reduction in the number of mistakenly inserted letters and write-overs, which are usually present in a crossword puzzle.

The puzzle has been shown in the form of a crossword puzzle in which each of the symbols corresponds to two distinct letters. In other embodiments the symbols may correspond to more than two characters or more than one symbol may correspond to a single letter. In addition, the puzzle may not be in the form of a crossword puzzle with interlocking words.

The invention is also not limited to letters and may include symbols corresponding to numbers, words, groups of letters or other representations. The puzzle may be in the form of an irregular shaped matrix of boxes of different shape. For example, the boxes may be hexagonal in shape with words being formed across, down and diagonally.

Accordingly, a puzzle with a matrix of defined spaces initially filled with symbols representative of at least two characters adapted to be converted or not, as the case may be, into the appropriate one of the at least two characters is presented.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A puzzle, comprising:

a plurality of symbols each of which is representative of at least two characters, some of the symbols adapted to be selectively converted to any one of the at least two corresponding characters and some of the symbols being adapted to either be selectively converted to at least one of the at least two corresponding characters or being adapted to not be converted and thereby representing the remaining one of the at least two corresponding characters;

a matrix of defined spaces, each of said spaces containing a symbol;

whereby the puzzle is solved by selectively converting some of said symbols to the appropriate corresponding character and by selectively not converting some of the symbols.

2. The puzzle of claim 1 wherein the matrix further includes spacing means for separating groupings of the spaces.

3. The puzzle of claim 1 further comprising assisting means for aiding in the solution of the puzzle.

4. The puzzle of claim 3 wherein the assisting means includes a series of clues to the correct conversion of the symbols to the appropriate corresponding characters.

5. The puzzle of claim 2 further comprising assisting means for aiding in the solution of the puzzle.

6. The puzzle of claim 2 wherein the assisting means includes a series of clues to the correct conversion of the symbols to the appropriate corresponding characters.

7. The puzzle of claim 1 wherein the characters are letters.

8. The puzzle of claim 7 where each of the symbols corresponds to two letters.

9. The puzzle of claim 7 wherein the plurality of symbols corresponds to the entire alphabet.

10. The puzzle of claim 9 wherein each letter in the alphabet corresponds to only a single letter.

11. The puzzle of claim 10 wherein there are 13 different symbols, each of which corresponds to two letters.

12. The puzzle of claim 2 wherein the characters are letters.

13. The puzzle of claim 12 wherein the matrix is organized as groupings of symbols corresponding to words, each of the words in a given direction being separated by the spacer means.

14. The puzzle of claim 13 wherein the matrix is a two dimensional arrangement of defined spaces and words are formed across and down.

15. The puzzle of claim 14 wherein words formed across and words formed down interlock with at least one other word in the other direction.

16. The puzzle of claim 13 further comprising assisting means for aiding in the solution of the puzzle.

17. The puzzle of claim 16 wherein the assisting means includes a series of clues for filling in each of the words.

18. A crossword puzzle, comprising:

a plurality of symbols each of which is representative of at least two characters, some of the symbols adapted to be selectively converted to any one of the at least two corresponding characters and some of the symbols being adapted to either be selectively converted to at least one of the at least two corresponding characters or being adapted to not be converted and thereby representing the remaining one of the at least two corresponding characters;

a grid of defined spaces, each of said spaces being one of a first type adapted to contain a symbol and a second type adapted to receive no symbol, each of the defined spaces of the first type containing one of said symbols; and assistance means for providing an aid in converting at least some of the symbols to an appropriate corresponding character;

whereby the puzzle is solved by selectively converting some of the symbols to the appropriate corresponding character and by selectively not converting some of the symbols.

19. The crossword puzzle of claim 18 wherein the characters are letters.

20. The crossword puzzle of claim 19 wherein each of the symbols corresponds to two letters.

21. The crossword puzzle of claim 19 wherein the matrix of defined spaces includes groupings of symbols corresponding to words, each of said words in a given direction being separated by at least one space of the second type.

22. The crossword puzzle of claim 21 wherein the assisting means inclues a clue for each of the words in the puzzle.

23. The crossword puzzle of claim 19 wherein there is at least one symbol for each letter in the alphabet.

24. The crossword puzzle of claim 19 wherein each letter corresponds to only a single symbol.

25. The crossword puzzle of claim 24 wherein there are 13 symbols, each of which corresponds to two letters.

* * * * *